US012161237B2

(12) United States Patent
McAndrew

(10) Patent No.: US 12,161,237 B2
(45) Date of Patent: Dec. 10, 2024

(54) OPEN DISPLAY REFRIGERATORS

(71) Applicant: Aerofoil Energy Limited, Cheshire (GB)

(72) Inventor: Paul McAndrew, Cheshire (GB)

(73) Assignee: Aerofoil Energy Limited, Chesire (GB)

( * ) Notice: Subject to any disclaimer, the term of this patent is extended or adjusted under 35 U.S.C. 154(b) by 417 days.

(21) Appl. No.: 17/541,927

(22) Filed: Dec. 3, 2021

(65) Prior Publication Data

US 2022/0087447 A1 Mar. 24, 2022

Related U.S. Application Data

(63) Continuation of application No. PCT/GB2020/051345, filed on Jun. 4, 2020.

(30) Foreign Application Priority Data

Jun. 4, 2019 (GB) ..... 1907965

(51) Int. Cl.
*A47F 3/04* (2006.01)
*F25D 17/08* (2006.01)
(Continued)

(52) U.S. Cl.
CPC ..... *A47F 3/0408* (2013.01); *A47F 3/043* (2013.01); *A47F 3/0434* (2013.01); *F25D 17/08* (2013.01);
(Continued)

(58) Field of Classification Search
CPC ..... A47F 3/0408; A47F 3/0447; F25D 17/08; F25D 23/028; F25D 23/062; F25D 2317/0671; F25D 2317/0672
(Continued)

(56) References Cited

U.S. PATENT DOCUMENTS 3,517,526 A 6/1970 MacMaster et al.
4,326,385 A 4/1982 Ibrahim
(Continued)

FOREIGN PATENT DOCUMENTS

CN 101046344 A 10/2007
DE 8228259 U1 2/1983
(Continued)

OTHER PUBLICATIONS

Examination Report, dated Aug. 30, 2021, for Gulf Cooperation Counsel Patent Application No. GC 2020-39860, 4 pages.
(Continued)

*Primary Examiner* — Steve S Tanenbaum
(74) *Attorney, Agent, or Firm* — Price Heneveld LLP

(57) ABSTRACT

The present invention provides an open display refrigerator comprising: a refrigerated storage space, air in the refrigerated storage space being separated from air exterior to the open display refrigerator by an air curtain established by a fan which blows air towards an air outlet and which recovers air in the air curtain via an air inlet for recirculation to the air outlet; a wall bounding at least a part of the duct and the refrigerated storage space, the wall comprising one or more voids such that air in the duct can flow into the refrigerated storage space via the one or more voids; a deflector which, when the refrigerator is in use, interrupts at least a portion of the flow of air from the one or more voids and directs the portion of the flow of air towards the top of the refrigerator.

20 Claims, 1 Drawing Sheet

(51) Int. Cl.
*F25D 23/02* (2006.01)
*F25D 23/06* (2006.01)

(52) U.S. Cl.
CPC ..... *F25D 23/028* (2013.01); *F25D 23/062* (2013.01); *F25D 2317/0671* (2013.01); *F25D 2317/0672* (2013.01)

(58) Field of Classification Search
USPC ..... 62/256
See application file for complete search history.

(56) References Cited

U.S. PATENT DOCUMENTS

| | | | | |
|---|---|---|---|---|
| 5,606,863 | A | 3/1997 | Kicklighter et al. | |
| 5,921,592 | A | 7/1999 | Donnelly | |
| 2001/0003248 | A1 | 6/2001 | Otto et al. | |
| 2005/0138943 | A1 | 6/2005 | Alahyari et al. | |
| 2005/0257548 | A1 | 11/2005 | Grassmuck et al. | |
| 2011/0259030 | A1 | 10/2011 | Anderson et al. | |
| 2015/0366373 | A1 | 12/2015 | Kim | |
| 2018/0084926 | A1 | 3/2018 | Watanabe et al. | |
| 2018/0103777 | A1* | 4/2018 | Bates | F25D 17/06 |
| 2018/0325284 | A1 | 11/2018 | McAndrew et al. | |
| 2019/0274452 | A1 | 9/2019 | McAndrew | |
| 2019/0281997 | A1 | 9/2019 | Nicholls | |
| 2019/0360738 | A1 | 11/2019 | McAndrew | |
| 2021/0045547 | A1 | 2/2021 | McAndrew | |
| 2022/0015556 | A1 | 1/2022 | McAndrew | |

FOREIGN PATENT DOCUMENTS

| | | | | | |
|---|---|---|---|---|---|
| DE | 29605097 | U1 | | 8/1996 | |
| DE | 102010013977 | A1 | | 10/2011 | |
| EP | 0403459 | A1 | | 12/1990 | |
| EP | 0441357 | A2 | | 8/1991 | |
| GB | 2126697 | A | * | 3/1984 | A47F 3/0447 |
| GB | 2198220 | A | | 6/1988 | |
| GB | 2484062 | A | | 4/2012 | |
| GB | 2555227 | A | | 4/2018 | |
| JP | S5085197 | U | | 7/1975 | |
| JP | S51150569 | U | | 12/1976 | |
| JP | S5374768 | U | | 6/1978 | |
| JP | S55165468 | A | | 12/1980 | |
| JP | S57152073 | U | | 9/1982 | |
| JP | S62162569 | U | | 10/1987 | |
| JP | H08320176 | A | | 12/1996 | |
| JP | 2011188889 | A | | 9/2011 | |
| JP | 2016016106 | A | | 2/2016 | |
| JP | 2016144599 | A | | 8/2016 | |
| KR | 20090106213 | A | | 10/2009 | |
| KR | 20120077259 | A | | 7/2012 | |
| WO | WO-2014167320 | A1 | | 10/2014 | |
| WO | WO-2019211619 | A1 | | 11/2019 | |
| WO | WO-2020109808 | A1 | | 6/2020 | |
| WO | WO-2020245584 | A1 | | 12/2020 | |

OTHER PUBLICATIONS

Examination Report, dated Nov. 30, 2022, for United Kingdom Application No. GB1907965.6, 5 pages.
Examination Report issued in Gulf Co-Operation Council Application No. GC 2020-39860 mailed on Jan. 27, 2021, 4 pages.
International Search Report and Written Opinion for International Application No. PCT/GB2020/051345 mailed on Aug. 12, 2020, 11 pages.
Search Report, dated Dec. 4, 2019, for United Kingdom Application No. GB1907965.6, 3 pages.

* cited by examiner

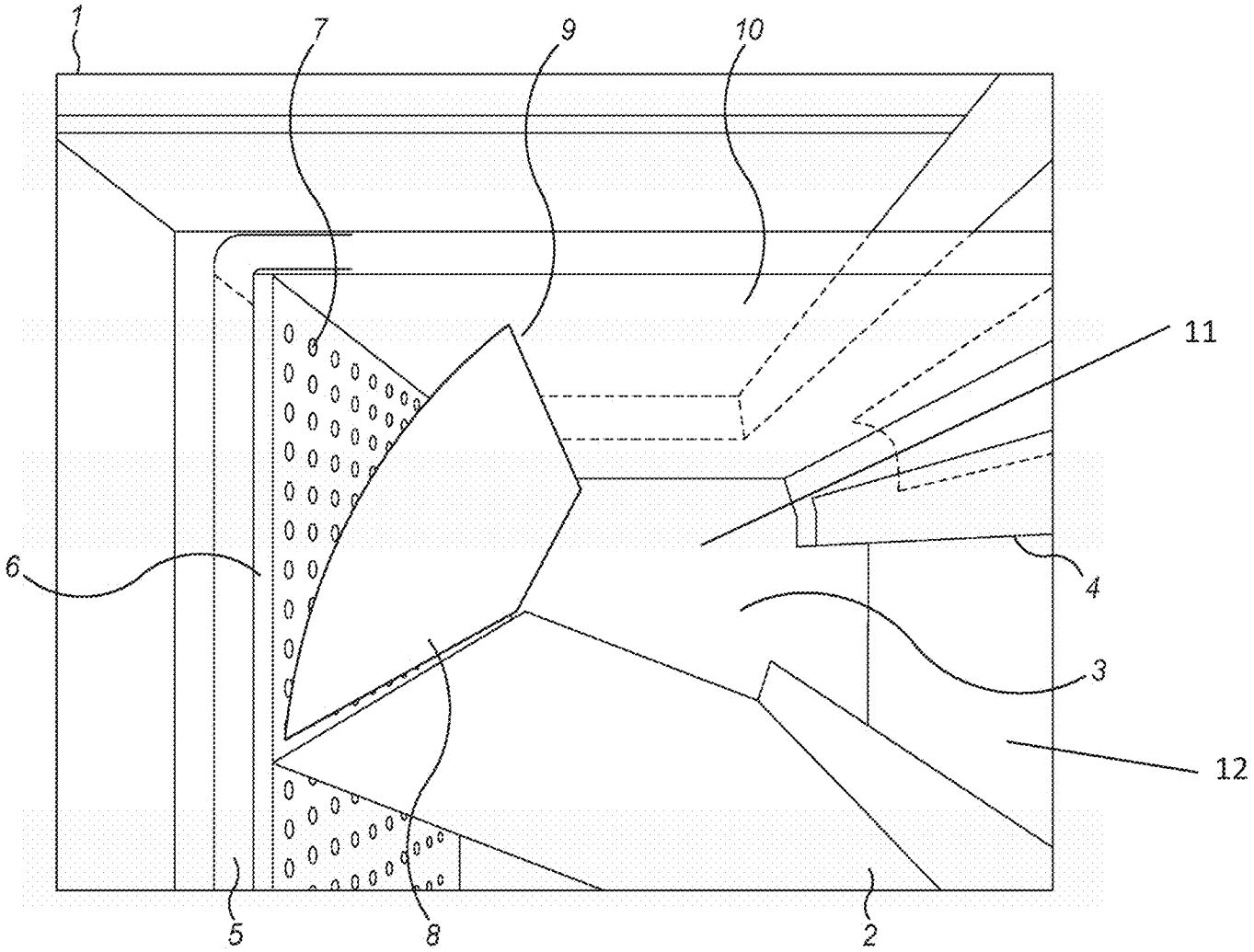
1
2
3
4
5
6
7
8
9
10
11
12

OPEN DISPLAY REFRIGERATORS

CROSS REFERENCE TO RELATED APPLICATIONS

This application is a continuation of International Patent Application No. PCT/GB2020/051345, entitled "Improvements To Open Display Refrigerators" and filed on Jun. 4, 2020, the entire contents of which are hereby incorporated by reference. International Patent Application No. PCT/GB2020/051345 claims priority to G.B. Application No. 1907965.2, entitled "Improvements To Open Display Refrigerators" and filed on Jun. 4, 2019.

FIELD

The invention relates to open display refrigerators, and to cooling units (refrigerators or freezers) which have doors comprising transparent windows.

BACKGROUND

Open display refrigerators are commonly used in retail environments, such as supermarkets, to store and display products, such as meat and dairy products, which must be kept at lower than ambient temperatures. The open front of such a refrigerator makes it easy for customers to view the products being displayed and to retrieve products they wish to purchase from the refrigerator.

This type of refrigerator has an air curtain, which is established by blowing cold air across the front of the refrigerator. The air curtain issues from an air outlet at the top of the refrigerator towards an air inlet at the bottom of the refrigerator. The air inlet recovers air from the air curtain and recirculates it to the air outlet via a cooling heat exchanger and fan.

Generally, it is intended that the air curtain follows a broadly linear path from the air outlet to the air inlet thereby preventing cold air in the refrigerator from mixing with warm air exterior to the refrigerator. However some configurations, usually with angled shelves, include a sizeable void between the uppermost shelf and the air outlet into which air from the air curtain tends to rush. This causes the air curtain to deviate from the intended generally linear path and move towards the interior of the refrigerator. Where the air curtain is drawn towards the interior of the refrigerator, the air flow of the air curtain is broken up and becomes more turbulent when compared to an air curtain that follows a generally linear path. The breaking up of the air curtain and the turbulence causes the air curtain to be less efficient at preventing cold air in the refrigerator from mixing with warm air exterior to the refrigerator and hence causes the interior of the refrigerator to be warmer than a refrigerator with a generally linear air curtain. A turbulent air curtain may also cause warm air exterior to the refrigerator to mix with the air curtain itself, reducing the efficiency of the refrigerator.

For refrigerators with an uppermost shelf that is installed at an angle to the normal, where an edge of the shelf distal to the rear of the refrigerator is lower than an edge of the shelf proximate the rear of the refrigerator, the void between the angled uppermost shelf and the air outlet is larger than with a refrigerator comprising a flat uppermost shelf that is not installed at an angle. Hence the issue of the air curtain deviating from a generally linear path when an angled shelf is used is even more pronounced. Generally these angled shelves do not have any additional air guides or aerofoils for guiding the air curtain, because they can be cumbersome to fit to angled shelves and generally retailers are unwilling to fit them to angled shelves. As such, it is important that the air curtain follows a generally linear path because the path of the air curtain is not purposefully altered or maintained between the point at which the air curtain is established and the point at which the air curtain enters the air inlet.

SUMMARY

In accordance with a first aspect of the invention, there is provided an open display refrigerator comprising: a refrigerated storage space, air in the refrigerated storage space being separated from air exterior to the open display refrigerator by an air curtain established by a fan which blows air towards an air outlet and which recovers air in the air curtain via an air inlet for recirculation to the air outlet; a wall bounding at least a part of the duct and the refrigerated storage space, the wall comprising one or more voids such that air in the duct can flow into the refrigerated storage space via the one or more voids; a deflector which, when the refrigerator is in use, interrupts at least a portion of the flow of air from the one or more voids and directs the portion of the flow of air towards the top of the refrigerator.

In accordance with a second aspect of the invention, there is provided a cooling unit comprising: an interior space, the interior space comprising (i) a refrigerated storage space and (ii) an access space, wherein air in the refrigerated storage space is separated from air in the access space by an air curtain established by a fan which blows air towards an air outlet and which recovers air in the air curtain via an air inlet for recirculation to the air outlet; a door, the door comprising a transparent window and which separates the interior space from air external to the cooling unit; a wall bounding at least a part of the duct and the refrigerated storage space, the wall comprising one or more voids such that air in the duct can flow into the refrigerated storage space via the one or more voids; a deflector which, when the refrigerator is in use, interrupts at least a portion of the flow of air from the one or more voids and directs the portion of the flow of air towards the top of the refrigerator.

Establishing the air curtain by a fan which blows air towards an air outlet and which recovers air in the air curtain via an air inlet for recirculation to the air outlet may also include recirculating the air via a cooling heat exchanger.

Unless specifically mentioned otherwise, the optional features described in the following paragraphs may relate to open display refrigerators or cooling units according to either of the first or second aspects of the invention.

In some embodiments, the deflector has: a first edge that is parallel to and proximate the wall and is parallel to and distal to an inner top surface of the refrigerator; and a second edge that is parallel to and proximate the inner top surface and is parallel to and distal to the wall.

In some embodiments, the first edge of the deflector is attached to the wall, such that a gap is formed between the second edge and the inner top surface. This causes the flow of air from the one or more voids to be deflected towards the inner top surface of the refrigerated storage space. A technical effect arises from this arrangement, because the gap created between the deflector and the inner top surface of the refrigerated storage space can act as a nozzle, thereby increasing the velocity of the flow of air. The flow of air with an increased velocity can then impinge on the air curtain, pushing the air curtain back out, away from the rear wall of the refrigerator. This reduces the impact of the void on the air curtain and hence causes the air curtain to follow a more linear path.

In some embodiments, the second edge of the deflector is attached to the inner top surface, such that a gap is formed between the first edge and the wall. A technical effect that arises from this arrangement is that air is forced down the wall and/or sides of the refrigerator, in a similar manner to that described in the previous paragraph, which can help to remove any condensation from these surfaces. In such an embodiment, there may be a gap between the shelves of the refrigerator and the wall, such that air can flow down the back wall.

It is also possible to attach the deflector to the wall and/or the inner top surface of the refrigerator, such that a gap is formed between the first edge and the wall and a gap is formed between the second edge and the inner top surface. This might be achieved, for example, by attaching a first end an arm to a surface of the deflector facing the wall of the refrigerator and a second end of the arm to the wall and/or inner top surface of the refrigerator. There may be one or more arms supporting the deflector. The first end of the one or more arms may be attached to either of, or both of, the first and/or second edges of the deflector. This might be in addition to, or instead of, attaching the first end of the arm to the surface of the deflector. The arm may comprise one or more joints. The arm may be joined at the first and/or second end via a hinge or ball joint. A jointed arrangement allows the deflector to be moved, thereby allowing the size of the gap between the first edge and the wall of the refrigerator to be increased or decreased and the gap between the second edge and the inner top surface of the refrigerator to be correspondingly decreased or increased. The arm may alternatively be a bracket and/or a similar structure.

In some embodiments, the deflector is mounted at an angle to the wall and/or the inner top surface.

In some embodiments, the deflector comprises a curved surface between the first edge and the second edge and wherein the curved surface faces the wall. A technical effect of the curved surface is to reduce the turbulence (i.e. make the air flow more laminar) of the air that passes through the voids in the wall and hits the deflector, as the air passes over the curved surface. This is advantageous, as the flow of air goes on to impinge the air curtain and a more laminar flow will reduce the disturbance of the downwards flow of the air curtain.

In some embodiments, the portion of the flow of air that has been directed by the deflector interacts with the air curtain, when the refrigerator is in use. As discussed above, the interaction may comprise the flow of air impinging on the air curtain, pushing the air curtain away from the refrigerator wall.

In some embodiments, the one or more voids comprises a plurality of perforations and/or one or more slots and/or a plurality of round holes and/or a plurality of geometric shapes. The geometric shapes may comprise circles, triangles, squares, pentagons, hexagons, heptagons, octagons or any other n-sided polygon. The voids may also comprise edges with a wavy or undulating profile. Alternatively, the edges may comprise chevrons or be saw-toothed. Different shapes give rise to different flow profiles. In some situations, more laminar flows may be preferred, in others more turbulent flows may be preferred. Likewise, different shapes may have an impact on any noise emanating from the refrigerator. The skilled person would be aware of the effect of different shapes on different flows and noise profiles, as such we do not detail these further here.

In some embodiments, the deflector comprises a surface facing away from the wall having a mirrored surface. A technical advantage of a mirrored surface is that it increases the amount of light that reaches products on the top shelf, thereby reducing the amount of lights needed to light the refrigerator and hence decreasing the energy consumption of the refrigerator. The mirrored surface may also increase the visibility of products on the top shelf.

In some embodiments, the mirrored surface is flat.

In some embodiments, the mirror surface is concave. A technical advantage of having a concave mirrored surface is that it magnifies the reflection and hence may make items on the shelf look more appealing to a customer.

BRIEF DESCRIPTION OF THE DRAWING

Embodiments of the invention will now be described with reference to the accompanying drawing, in which:

FIG. 1 shows a cross-section through an open display refrigerator with a deflector.

DETAILED DESCRIPTION

The open display refrigerator 1 has a storage space 11 that is maintained at a lower than ambient temperature. Within the storage space there are angled storage shelves 2. Different embodiments may have one, two, three, four, five or any number of angled storage shelves. Although some of the storage shelves may be flat rather than angled, the uppermost storage shelf is usually angled. A typical angle for the angled storage shelves is 20°, however shelves at other angles may be used, as long as the product being refrigerated does not slide off the shelves. As can be seen, a void 3 is formed between the uppermost storage shelf 2 and the air outlet 4. The refrigerator 1 may establish an air curtain (not shown) by a fan (not shown) which blows cold air towards the air outlet 4, out of the air outlet 4 and towards an air inlet, where the air curtain separates the storage space 11 from an access space 12. The air inlet recovers air from the air curtain and a fan (not shown) within the refrigerator 1 may recirculate the air through a duct 5 to the air outlet 4. A cooling unit or heat exchanger (not shown) within the refrigerator 1 may maintain the recirculated air (and hence the air blown through the air outlet 4 to form the air curtain) at a desired temperature. The desired temperature is chosen to be lower than ambient and acts to prevent cold air in the storage space from mixing with warm air exterior to the refrigerator. As previously mentioned, air from the air curtain may be drawn into the void 3, causing the air curtain to deviate from the intended linear path. The duct 5 is bounded by a wall 6 comprising a plurality of perforations 7. As discussed above, these perforations may be any suitable size and/or shape. A part of the recirculated air passes from the duct 5, through the perforations 7 and hits the deflector 8. The air follows the curved surface of the deflector 8 and the gap 9 between the top edge of the deflector 8 and the inner top surface of the refrigerator 10. The gap 9 may act as a nozzle, thereby increasing the speed of the flow of air. This flow of air travels along the inner top surface of the refrigerator 10 and impinges on the air curtain, thereby pushing the air curtain out of the void 3 and causing it to flow from the air outlet 4 to the air inlet in a more linear fashion.

The invention claimed is:

1. An open display refrigerator comprising:

a housing defining a refrigerated storage space;

a fan configured to establish an air curtain that separates the refrigerated storage space from an exterior of the housing;

an air inlet configured to recover air from the air curtain for recirculation to an air outlet;

a wall bounding at least a part of an air duct and the refrigerated storage space, the wall including one or more apertures such that air in the duct can flow into the refrigerated storage space via the one or more apertures;

a shelf which is installed within the storage space at an angle such that an edge of the shelf distal to the wall is lower than an edge of the shelf proximate the wall; and a deflector configured to interrupt at least a portion of the flow of air from the one or more apertures and direct the portion of the flow of air towards a top of the housing, wherein the deflector includes a surface facing away from the wall and having a mirrored surface, a first edge that is parallel to and proximate the wall and is parallel to and distal to an inner top surface of the refrigerator, and a second edge that is parallel to and proximate the inner top surface and is parallel to and distal to the wall.

2. The open display refrigerator claim 1, wherein the first edge of the deflector is attached to the wall, such that a gap is formed between the second edge and the inner top surface of the housing.

3. The open display refrigerator claim 1, wherein the second edge of the deflector is attached to the inner top surface of the housing, such that a gap is formed between the first edge and the wall.

4. The open display refrigerator or the cooling unit of claim 1, wherein the deflector is mounted at an angle to the wall and/or the inner top surface of the housing.

5. The open display refrigerator or the cooling unit of claim 1, wherein the deflector includes a curved surface between the first edge and the second edge, the curved surface facing the wall.

6. The open display refrigerator of claim 1, wherein the deflector is configured to direct the portion of the flow of air such that the portion of the flow of air interacts with the air curtain.

7. The open display refrigerator of claim 1, wherein the at least one aperture includes a plurality of apertures formed in the wall.

8. The open display refrigerator of claim 1, wherein the at least one aperture includes a plurality of slots formed in the wall.

9. The open display refrigerator of claim 1, wherein the at least one aperture includes a plurality of round holes formed in the wall.

10. The open display refrigerator of claim 1, wherein the at least one aperture includes a plurality of geometric shapes formed in the wall.

11. The open display refrigerator or the cooling unit of claim 1, wherein the mirrored surface is flat.

12. The open display refrigerator or the cooling unit of claim 1, wherein the mirrored surface is concave.

13. The open display refrigerator of claim 1, wherein the shelf is an uppermost shelf.

14. A cooling unit, comprising:

a housing defining an interior space that includes, (i) a refrigerated storage space and (ii) an access space;

a fan configured to establish an air curtain that separates air in the refrigerated storage space from air in the access space;

an air inlet configured to recover air from the air curtain such that the air can be recirculated to an air outlet;

a door that separates the interior space from air external to the housing;

a wall bounding at least a part of an air duct and the refrigerated storage space, the wall including one or more apertures such that air in the duct can flow into the refrigerated storage space via the one or more apertures;

a shelf which is installed within the storage space at an angle such that an edge of the shelf distal to the wall is lower than an edge of the shelf proximate the wall; and a deflector configured to interrupt at least a portion of the flow of air from the one or more apertures and direct the portion of the flow of air towards the top of the housing, wherein the deflector includes a surface facing away from the wall having a mirrored surface, a first edge that is parallel to and proximate the wall and is parallel to and distal to an inner top surface of the refrigerator, and a second edge that is parallel to and proximate the inner top surface and a parallel to and distal to the wall.

15. The cooling unit of claim 14, wherein the first edge of the deflector is attached to the wall such that a gap is formed between the second edge and the inner top surface of the housing.

16. The cooling unit of claim 14, wherein the second edge of the deflector is attached to the inner top surface of the housing, such that a gap is formed between the first edge and the wall.

17. The the cooling unit of claim 14, wherein the deflector is mounted at an angle to the wall and/or the inner top surface of the housing.

18. The cooling unit of claim 14, wherein the deflector includes a curved surface between the first edge and the second edge, the curved surface facing the wall.

19. The open display refrigerator of claim 14, wherein the deflector is configured to direct the portion of the flow of air such that the portion of the flow of air interacts with the air curtain.

20. The cooling unit of claim 14, wherein the shelf is an uppermost shelf.

* * * * *